US005762227A

United States Patent [19]

Mitchell

[11] Patent Number: 5,762,227

[45] **Date of Patent: *Jun. 9, 1998**

[54] SPREADABLE CIRCULAR CLAMP RING AND SALVAGE DRUM INCLUDING SAME

[75] Inventor: Donald J. Mitchell, Wellsburg, W. Va.

[73] Assignee: Eagle Manufacturing Co., Wellsburg, W. Va.

[ * ] Notice: The term of this patent shall not extend beyond the expiration date of Pat. No. 5,590,802.

[21] Appl. No.: 668,912

[22] Filed: Jun. 24, 1996

Related U.S. Application Data

[63] Continuation-in-part of Ser. No. 520,080, Aug. 28, 1995, Pat. No. 5,590,802.

[51] Int. Cl.[6] ..... B65D 8/12; B65D 45/34; B65D 53/02

[52] U.S. Cl. ..... 220/321; 220/320; 220/378; 220/675

[58] Field of Search ..... 220/321, 320, 220/319, 315, 214, 648, 658, 659, 671, 378, 675, 669

[56] References Cited

U.S. PATENT DOCUMENTS

| | | | |
|---|---|---|---|
| Re. 28,521 | 8/1975 | Hammes . | |
| 1,504,194 | 8/1924 | Treanor . | |
| 1,712,274 | 5/1929 | Knowles . | |
| 2,680,536 | 6/1954 | Kojan | 220/321 |
| 2,727,673 | 12/1955 | Bergstrom . | |
| 3,193,129 | 7/1965 | Pfluger et al. | 220/321 X |
| 3,696,962 | 10/1972 | Fehres et al. . | |
| 4,094,432 | 6/1978 | Zilbert . | |
| 4,177,934 | 12/1979 | Hammes et al. . | |
| 4,267,940 | 5/1981 | Wade | 220/321 |
| 4,648,522 | 3/1987 | Wise . | |
| 4,708,258 | 11/1987 | Shaw et al. . | |
| 4,709,833 | 12/1987 | Granberg et al. . | |
| 4,890,756 | 1/1990 | Waltke | 220/321 |
| 5,096,083 | 3/1992 | Shaw et al. . | |
| 5,180,076 | 1/1993 | Hundt . | |
| 5,193,715 | 3/1993 | Schultz . | |
| 5,259,526 | 11/1993 | Stolzman . | |
| 5,358,133 | 10/1994 | Gillispie et al. . | |
| 5,373,958 | 12/1994 | Bokmiller . | |
| 5,427,264 | 6/1995 | Addison . | |
| 5,590,802 | 1/1997 | Mitchell | 220/321 |

FOREIGN PATENT DOCUMENTS

| | | | |
|---|---|---|---|
| 000499191 | 8/1992 | European Pat. Off. | 220/321 |
| 0364361 | 8/1906 | France . | |
| 609730 | 9/1960 | Italy | 220/321 |
| 092012062 | 7/1992 | WIPO . | |

*Primary Examiner*—Allan N. Shoap
*Assistant Examiner*—Niki M. Kopsidas
*Attorney, Agent, or Firm*—Armstrong, Westerman, Hattori, McLeland & Naughton

[57] ABSTRACT

A spreadable circular ring clamp has first, second and third clamp sections, which have inwardly directed upper and lower walls, which are secured together by connector strips that are secured to the outer surface of outer wall of the clamp sections. A locking device is provided to lock together locking ends of the first and second clamp sections. In unlocked position, the locking ends of the first and second clamp sections may be spread apart to open the clamp ring, while in locked position the clamp ring will provide sealing of a lid to a container body.

14 Claims, 9 Drawing Sheets

SPREADABLE CIRCULAR CLAMP RING AND SALVAGE DRUM INCLUDING SAME

CROSS-REFERENCE TO RELATED APPLICATION

This application is a continuation-in-part of application Ser. No. 08/520,080 filed Aug. 28, 1995 now U.S. Pat. No. 5,590,802 in the name of Donald J. Mitchell and entitled "Salvage Drum with Protected Clamping", said application assigned to the assignee of the present application, and incorporated by reference herein.

FIELD OF THE INVENTION

The present invention relates to a spreadable circular clamp ring and a salvage drum incorporating the spreadable circular clamp ring.

BACKGROUND OF THE INVENTION

As explained in co-pending application Ser. No. 08/520,080, salvage drums are used to ship and store contaminated solids, or ship and store industrial drums containing oil, solvents, or the like, and are generally of a size such that the contents of the industrial drum will be retained in the salvage drum upon spilling or leakage.

Also, as explained, a salvage drum must conform to the strict requirements of the United States Department of Transportation, and pass tests such as drop tests and internal pressure or leak-proofness tests, while maintaining a seal of the container, and stacking tests, which require a bottom sealed container to retain its seal when other sealed containers are stacked thereon. In one top corner drop test, a loaded, sealed container is dropped on an angle (about 70°) from a height onto the floor so that the upper corner of the container will impact with the floor and the salvage drum must remain sealed after such a drop. The corner drop test is a difficult test which must be passed in order to qualify for Department of Transportation clearance whether threaded lids are used or whether a clamp is used to secure a lid to a container body. Where a clamp is used, for example, impact of the clamp with the ground can cause damage to the clamp and result in leakage from a sealed salvage drum. An internal air pressure test which must be passed in order to qualify a container as a salvage drum requires that the lid retain a seal with the container body when an internal air pressure of at least 3 pounds per square inch is present in the sealed container. In some containers where a seal is provided at the top of the container wall with a clamped lid, the lid will tend to deflect upon a buildup of internal pressure and bulges to an extent which causes a break in the seal between the container body and a lid.

It is an object of the present invention to provide a spreadable circular clamp ring that is usable to seal a lid to a container body where both the lid and container body have outwardly extending lips thereon.

It is another object of the present invention to provide a spreadable circular ring clamp having confronting ends which ends may be spread apart so as to fit the clamp over coacting lid and container lips of a salvage drum and locked together to seal the contents of the drum.

It is a further object of the present invention to provide a salvage drum having a lid secured to a container body by a spreadable circular ring clamp where the clamp is protected from direct impact with the ground upon tipping or dropping of the salvage drum so as to maintain the salvage drum in a sealed condition.

SUMMARY OF THE INVENTION

A spreadable circular ring clamp is provided for securing a container lid to a container body where a body lip and lid lip are to be secured together.

The spreadable circular ring clamp has first, second and third arcuate clamp sections, each of which has an outer wall surface and inwardly directed upper and lower walls. The first and second clamp sections each have a connecting end and a locking end, while the third clamp section has two connecting ends. A first connector strip secures the connecting end of the first clamp section to a first connecting end of the third clamp section while a second connecting strip secures the connecting end of the first clamp section to a second connecting end of the third clamp section. A locking device is provided that enables spreading apart of locking ends of the first and second clamp sections in an unlocked position and locks those ends together when the spreadable circular ring clamp is in locked position.

The spreadable circular ring clamp is especially useful in clamping a body lip and a lid lip together to seal a container, such as a salvage drum. The salvage drum preferably has a container body and a circular lid. The container body has a bottom wall and an upwardly extending side wall terminating to form a circular open top, with a radially outwardly extending lip on the side wall about the top, and vertically extending ribs on the side wall adjacent the lip. The circular lid has a radially outwardly extending lip about the periphery thereof and an outwardly extending protective shoulder.

The spreadable circular ring clamp is spreadable so as to enable easy placement over the two mating lips and when in locked position is protected from impact upon dropping or tilting of the salvage drum by the vertical ribs and lid protective shoulder.

BRIEF DESCRIPTION OF THE DRAWINGS

The present invention will be more readily understood by reference to the drawings which illustrate a preferred embodiment of the salvage drum wherein.

DETAILED DESCRIPTION

The present invention provides a salvage drum for the storage and containment of materials where a clamp is used to seal a circular lid to a container body and the clamp is protected such that it will not impact with the ground regardless of how the salvage drum is dropped, and provides a novel spreadable circular ring clamp for use with the salvage drum.

Figure 1:
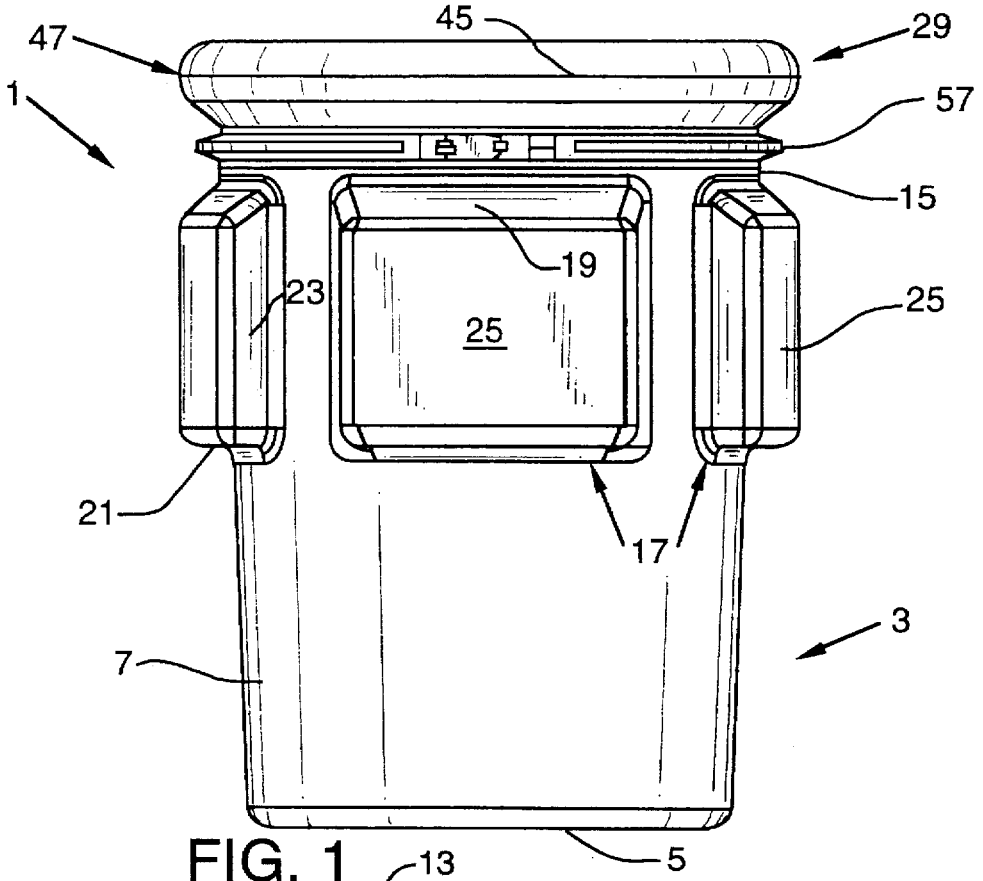
FIG. 1 is a side elevational view of the assembled salvage drum of the present invention showing a conventional clamping device sealing the circular lid to the container body.
Figure 2:
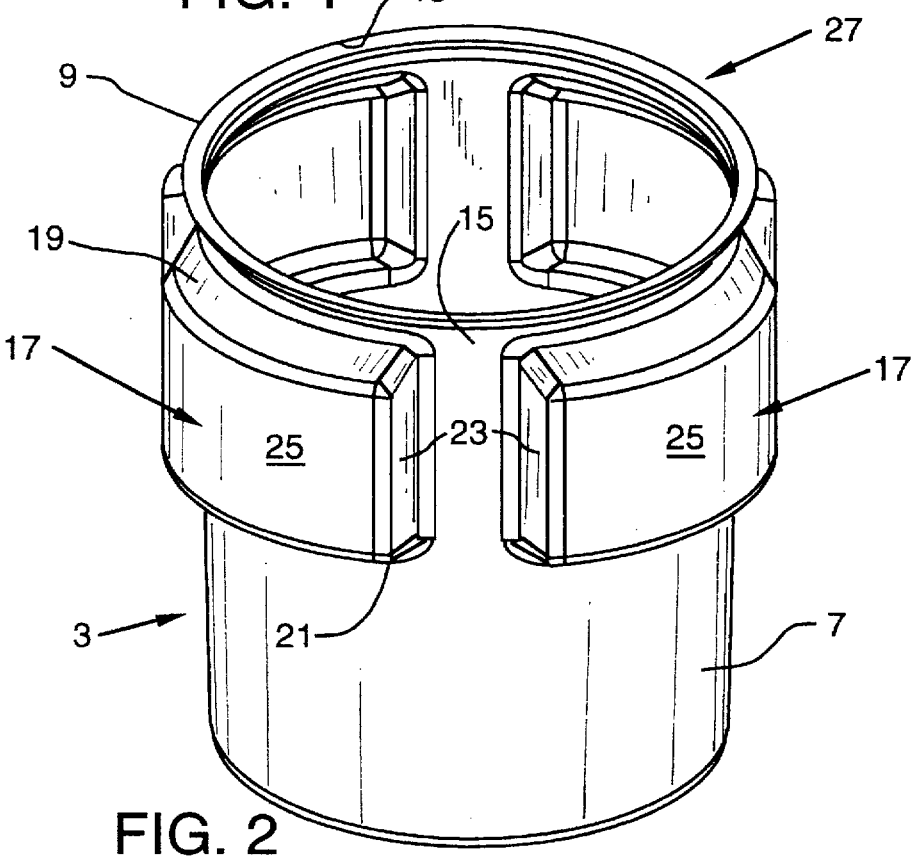
FIG. 2 is an isometric view of the body portion of the salvage drum of the present invention.
Figure 3:
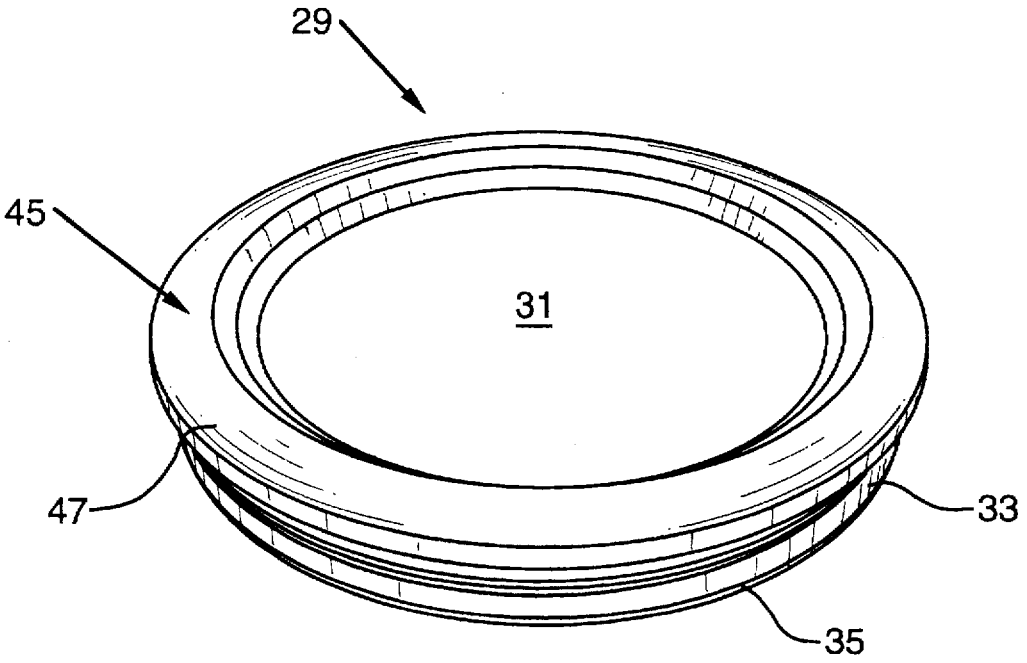
FIG. 3 is an isometric view of the circular lid of the salvage drum of the present invention.
Figure 4:
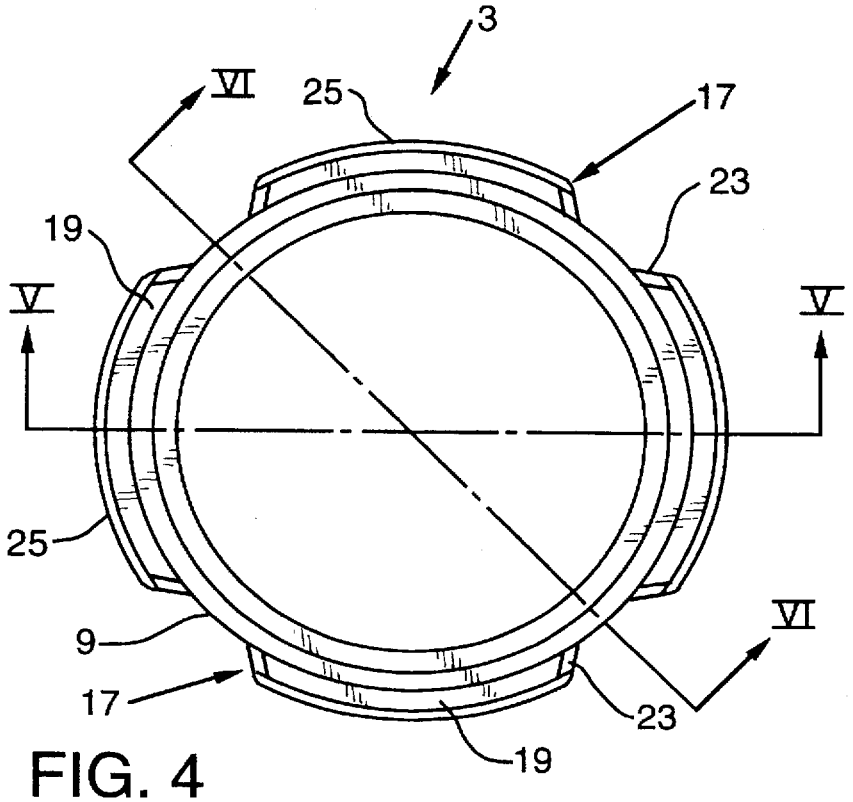
FIG. 4 is top plan view of the body portion of FIG. 2.
Figure 5:
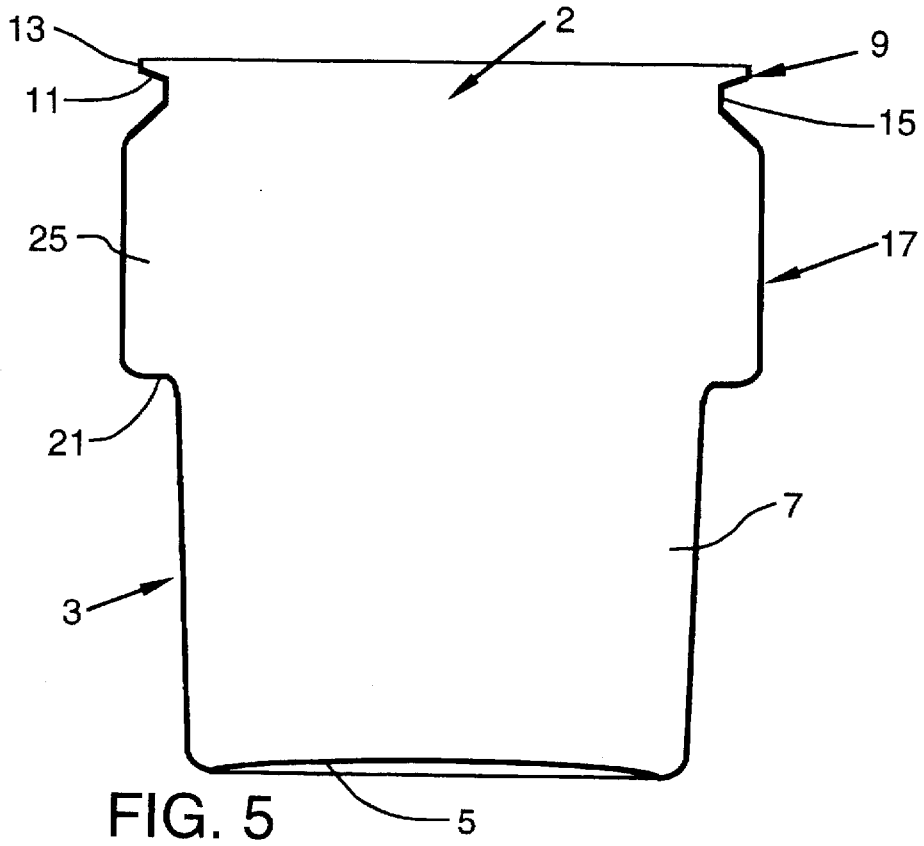
FIG. 5 is cross-sectional view of the body portion taken along lines V—V of FIG. 4.
Figure 6:
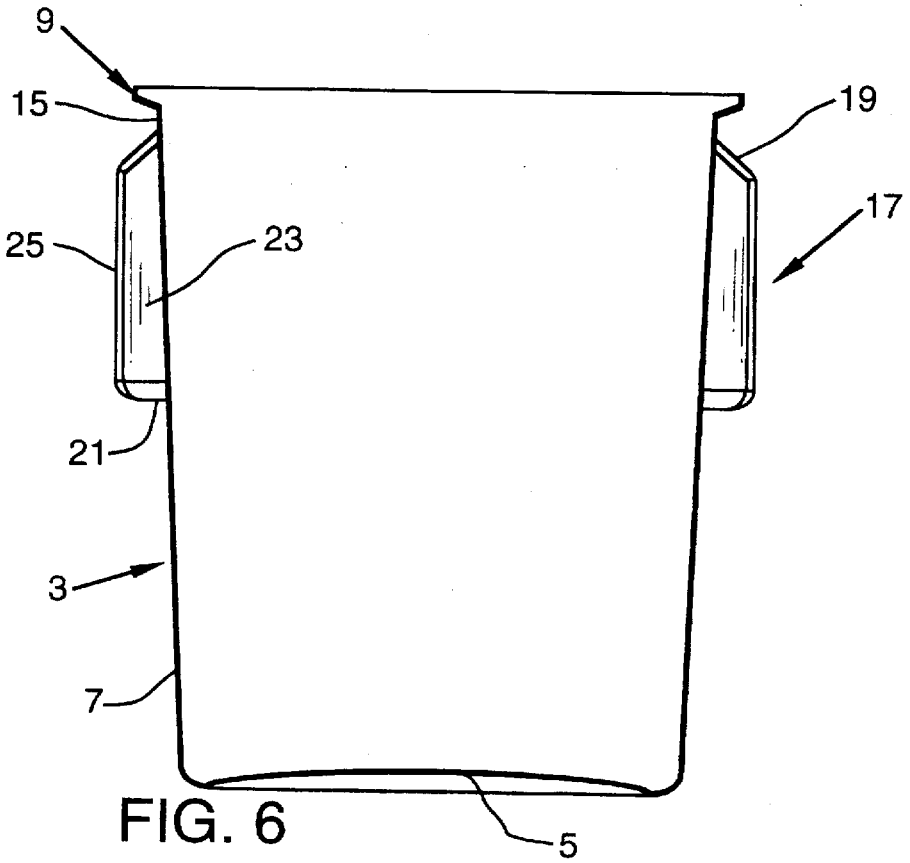
FIG. 6 is a cross-sectional view of the body portion taken along lines VI—VI of FIG. 4.

Referring now to the drawings, FIGS. 2, 4, 5 and 6 illustrate the container body 3 of the salvage drum 1 of the present invention, the sealed salvage drum 1 shown in FIG. 1. The container body 3 has a bottom wall 5 and an upwardly extending side wall 7 which terminates as a radially outwardly extending lip 9, the lip 9 preferably having an upwardly sloped lower surface 11 and a short upwardly extending retention flange 13 at the end thereof. The side wall 7 of the container body 3 is tapered outwardly from the bottom wall 5 towards the lip 9 so as to permit nesting of container bodies. Also, there is preferably provided on the side wall 7 a vertical, non-tapered section 15 adjacent the lip 9. The side wall 7 has a plurality of spaced outwardly extending vertical ribs 17 formed therein, each rib 17 preferably having an upper wall 19, lower wall 21, side walls 23 and outer wall 25. The number of outwardly extending vertical ribs 17 formed in the side wall (four shown) may vary provided that the number present is sufficient to provide protection for a clamping device as described later herein. The outwardly extending vertical ribs 17 are spaced from and adjacent to the radially outwardly extending lip 9 on the container body 3. The lip 9 of the container body forms a circular open top 27 for placement of a drum, such as a solvent drum, into the container body 3 of the salvage drum 1.

A circular lid 29 is provided for the salvage drum 1 which, as best illustrated in FIGS. 3 and 8–13, has a top wall 31 and a downwardly depending skirt 33 which has a radially outwardly extending lid lip 35 about the periphery thereof. The lid lip 35 preferably has a downwardly sloped upper surface 37 and a short downwardly extending retention flange 39 which, with the lower edge 41 of the downwardly depending skirt 33 forms a gasket receiving channel 43 in the lid lip 35. Also about the periphery of the circular lid 29 there is provided an outwardly extending protective shoulder 45, the shoulder preferably being a hollow shoulder with a radially outermost surface 47, which is preferably an arcuate surface. The outwardly extending protective shoulder may, if desired, be formed as a plurality of spaced outwardly extending shoulder portions, provided the protection of the clamp, as hereinafter described, is effected. The circular lid may have a series of hollow reinforcing ribs 49 on the underside 51 of the top wall 31, which ribs may comprise circular ribs 53 and radially extending ribs 55.

Figure 14:
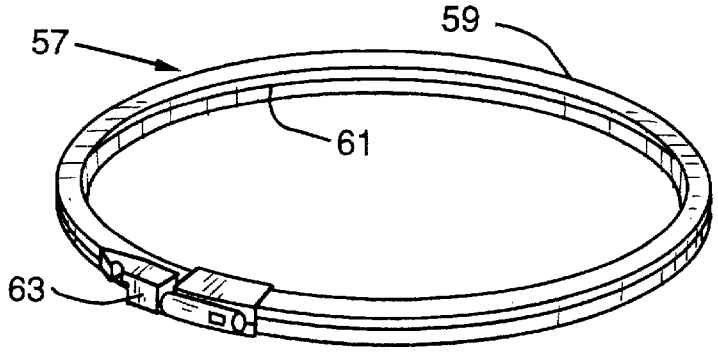
FIG. 14 is an isometric view of a conventional clamping device used on the salvage drum of the present invention.

The circular lid 29 is secured to the container body 3 by means of a clamping device, a conventional clamping device 57 being shown in FIG. 14. The conventional clamping device 57 is a clamp 59, which may be formed from metal, having a V-shape, with a groove 61 formed by the V-shape, and a locking means 63.

Figure 7:
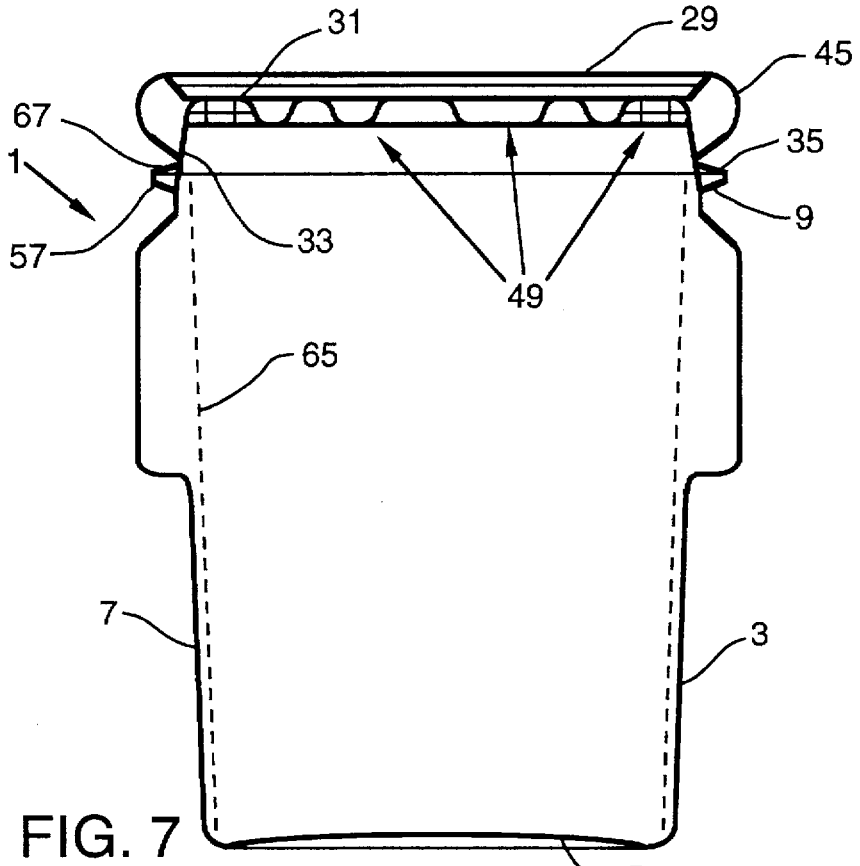
FIG. 7 is a vertical cross-sectional view of the assembled salvage drum shown in FIG. 1.
Figure 8:
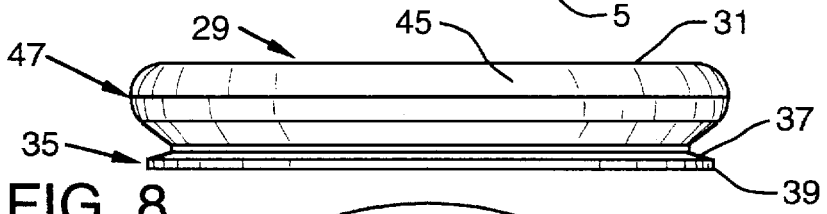
FIG. 8 is a side elevational view of the circular lid shown in FIG. 3.
Figure 9:
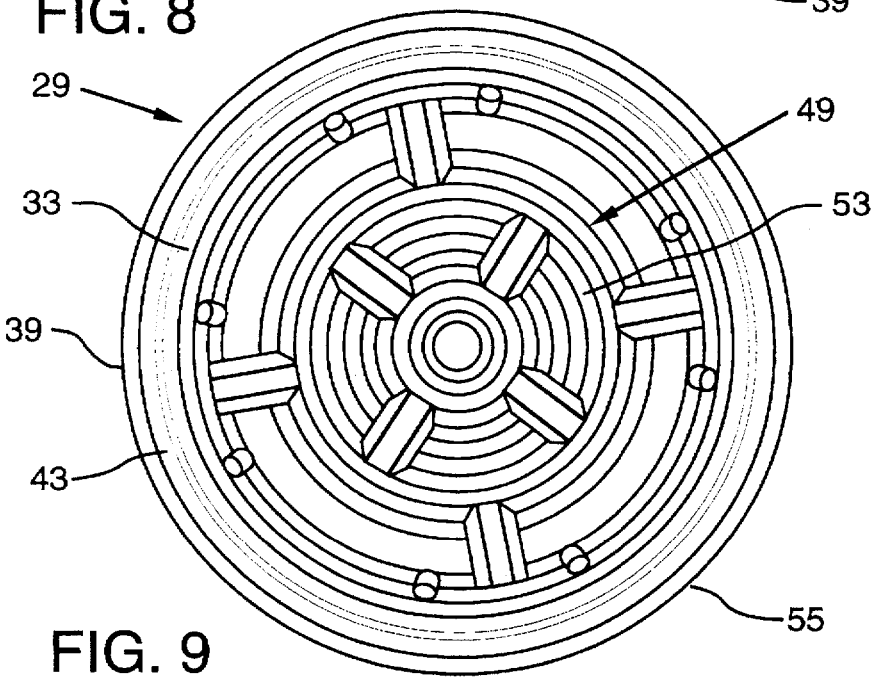
FIG. 9 is a bottom plan view of the circular lid shown in FIG. 3.
Figure 10:
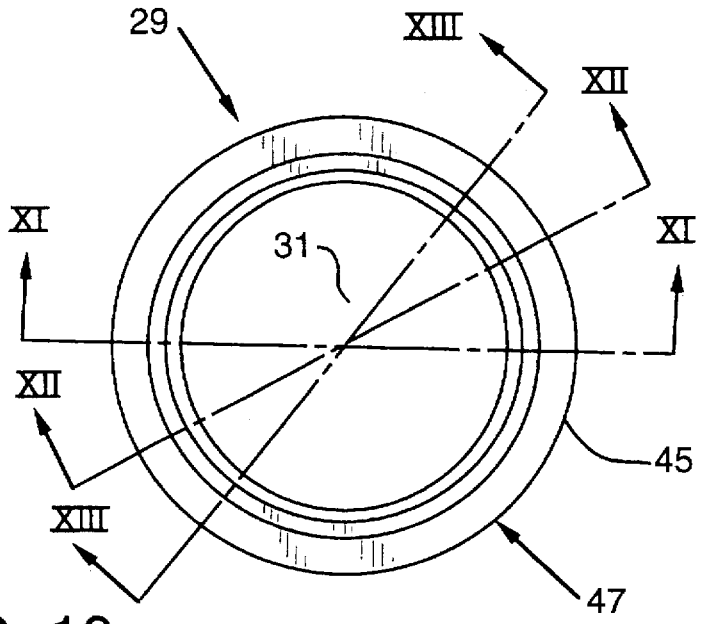
FIG. 10 is a top plan view of the circular lid shown in FIG. 3.
Figure 11:
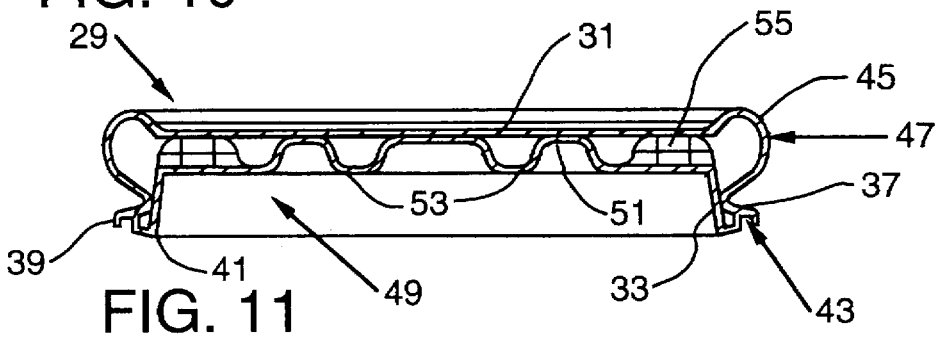
FIG. 11 is a cross-sectional view of the circular lid taken along lines XI—XI of FIG. 10.
Figure 12:
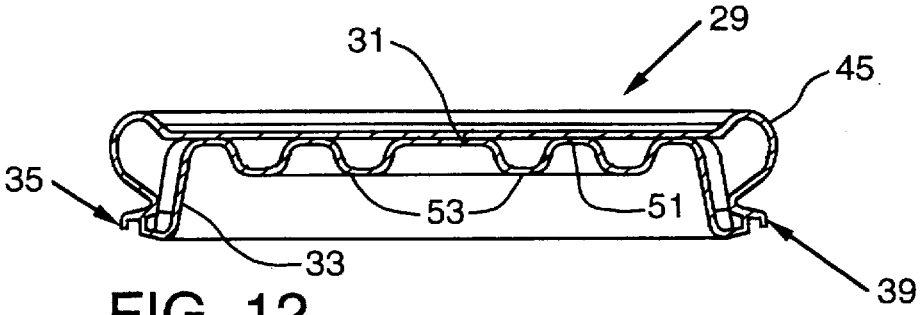
FIG. 12 is a cross-sectional view of the circular lid taken along lines XII—XII of FIG. 10.
Figure 13:
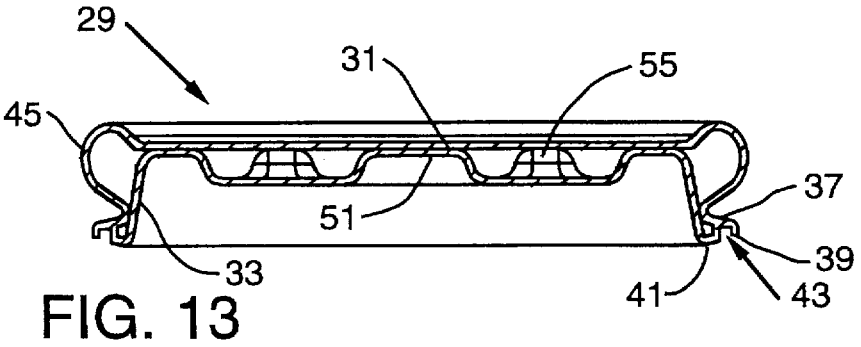
FIG. 13 is a cross-sectional view of the circular lid taken along lines XIII—XIII of FIG. 10.

In use, a drum 65, such as an industrial drum, shown in dashed lines in FIG. 7, is placed into the container body 3, and a clamping device 57, such a V-shaped clamp," is provided which may have been previously placed over the body lip 13 and rested on the upper walls 19 of the vertical ribs 17. A circular gasket 67 is preferably placed on the lid lip 35, within the gasket receiving channel 43, and may be adhesively secured in the channel 43. The circular lid 29 is then placed on the container body 3 with the gasket 67 contained with the confines of the channel 43 formed by the downwardly extending retention flange 39 of the radially outwardly extending lid lip 35, and contacting the upwardly extending flange 13 of body lip 9 (FIG. 15) to provide a seal. The V-shaped clamp 57 is then opened, if necessary, and raised a sufficient amount to allow the clamp to be placed over the lid lip 35 and body lip 9 and the clamp 57 closed and locked in place by locking means 63, so as to secure the circular lid 29 to the body portion 3 and compress the gasket 67 to seal the contents of the salvage drum 1 therein.

Figure 15:
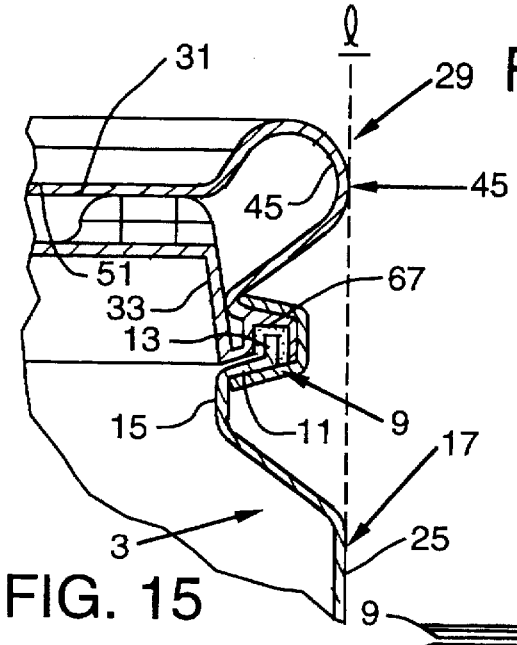
FIG. 15 is a vertical cross-sectional view showing the seal formed between the circular lid and container body by the clamping device.

When the salvage drum 1 is sealed, the clamp 57 will be protected from impact with any wall area or ground surface. As best shown in FIG. 15, with the clamp 57 situated radially inwardly from the upper outer surface 25 of the vertical rib 17 on the side wall 7 of the container body 3, and also situated radially inwardly from the outermost surface 47 of the outwardly extending protective shoulder 45 of the circular lid 29, as illustrated by the dashed line 1 in FIG. 15, the clamp will be protected from any impact with a wall surface or ground surface regardless of the tipping or dropping of the salvage drum 1. The location of the clamp at the lid lip 35 which is spaced from the top wall 31 by downwardly depending skirt 33, provides a seal between the lid lip 35 and body lip 9 below the top wall 31 that will, when clamped, provide a seal which will withstand an internal pressure of 3 pounds per square inch or more without bulging of the lid breaking such a seal.

Figure 16:
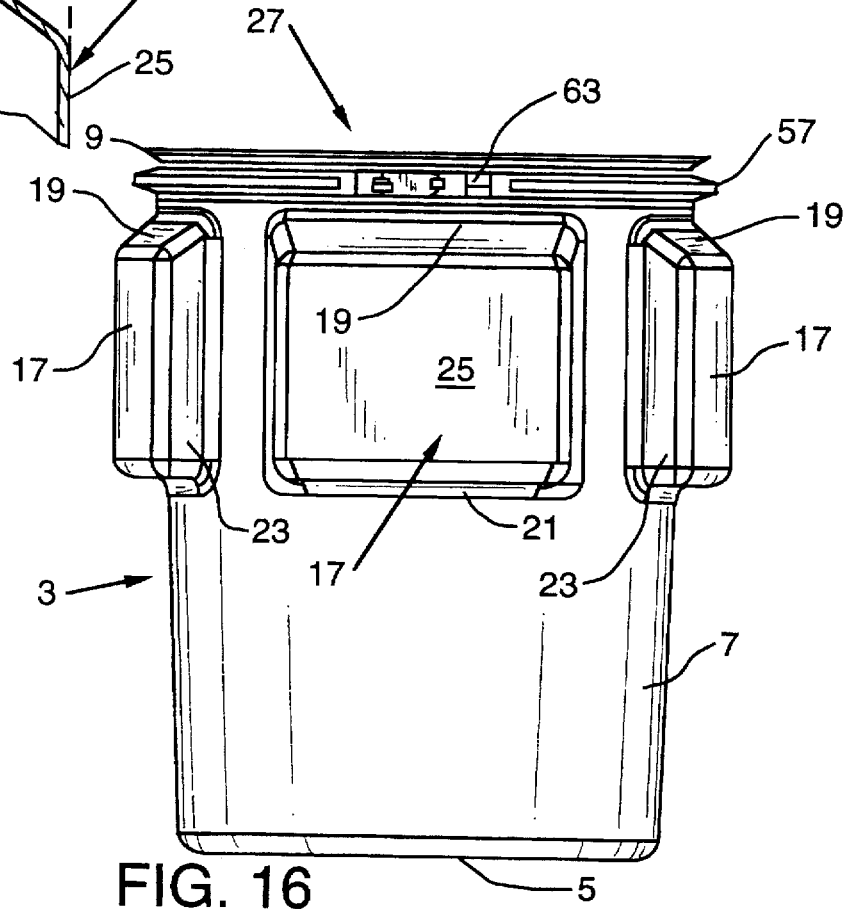
FIG. 16 is a side view of the container body of FIG. 2 with the novel clamping device of FIG. 17 held therein during shipment, with the novel clamping device resting on the vertical ribs on the container body.
Figure 17:
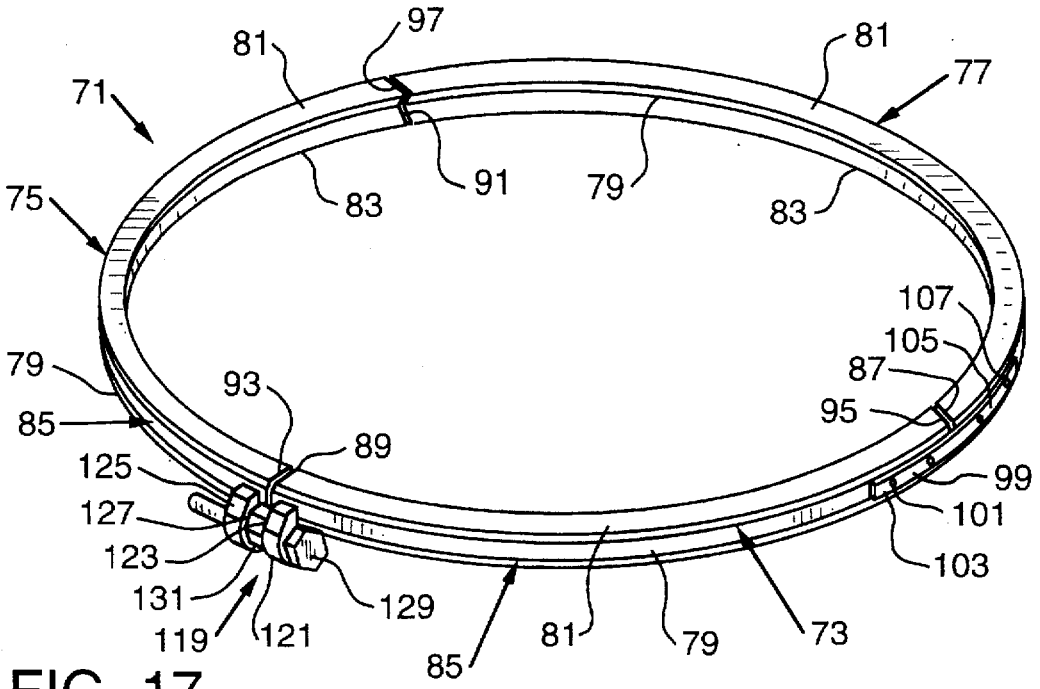
FIG. 17 is an isometric view of a novel spreadable circular ring clamp usable with the salvage drum of the present invention.
Figure 18:
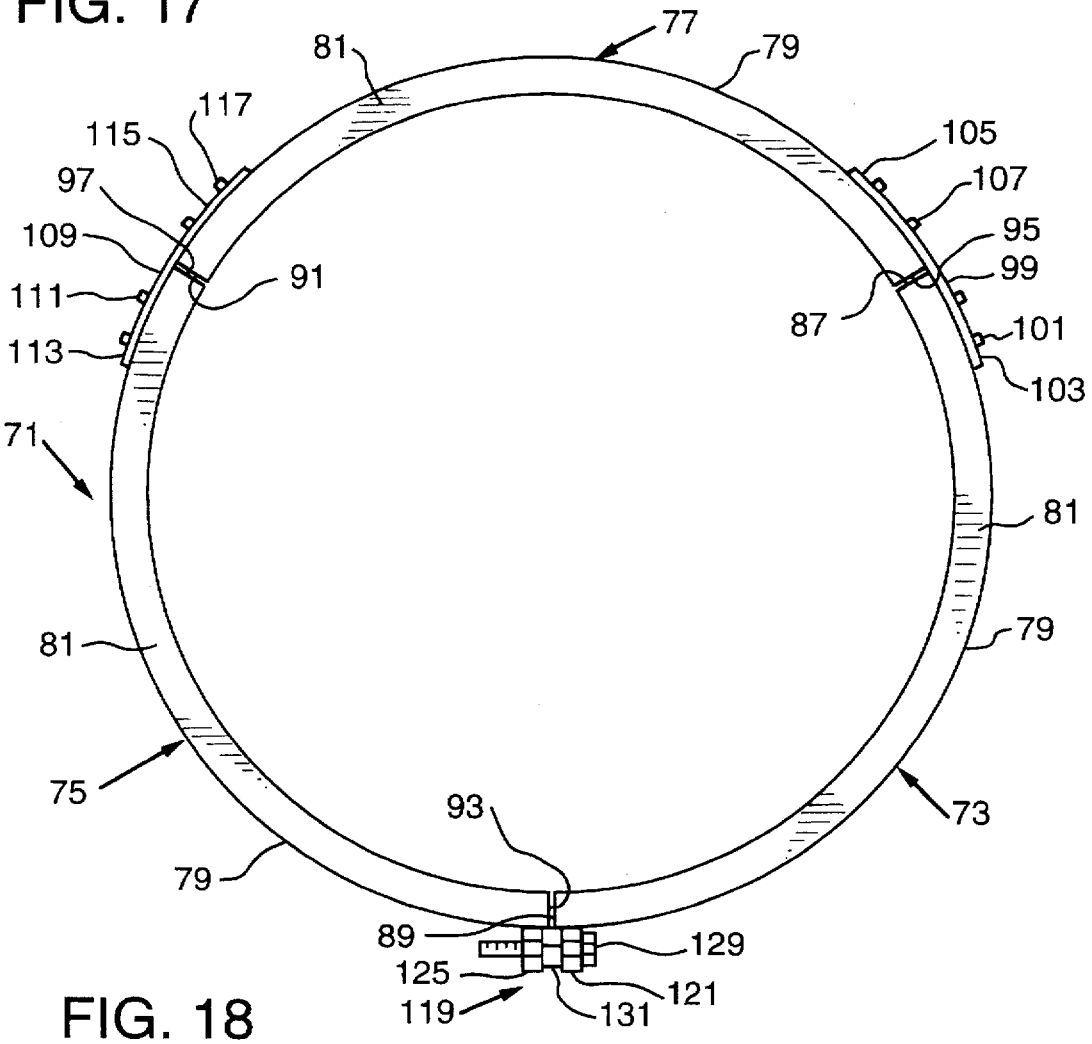
FIG. 18 is a top plan view of the spreadable circular ring clamp illustrated in FIG. 17.

An advantage of the construction of the container body 3 of the present invention, where the vertical, non-tapered section 15 is provided on the side wall 7 and the outwardly extending ribs 17 are positioned adjacent the body lip 9, is illustrated in FIG. 16, which illustrates the use of horizontal grooves 69, which serve to receive the forks of a fork lift or as hand holds for lifting and moving of the salvage drum, in the vertical, outwardly extending ribs 17, and a novel spreadable circular clamp ring 71 resting on the ribs 17. As shown in that figure, the clamp 57 or 71 may be passed over the body lip 9 of the container body 3 and rested on the upper wall 19 of the outwardly extending ribs 17 for holding during shipping and storage. The clamp 57 or 71 may be closed to tightly hold the same to the vertical, non-tapered section 15. When used for clamping the circular lid to the container body, the clamp 57 or 71 need only be opened, if necessary, and raised to the proper position and secured in place over the lid lip 35 and the body lip 9. With holding of the clamp 57 or 71 about the vertical, non-tapered section 15 of side wall 7 of the container body 3 on the container body, while resting on the vertical, outwardly extending ribs 17, the user of the salvage drum 1 need not be concerned with loss or damage of the clamp 57 or 71 before use in clamping the circular lid 29 to the container body 3. Also, when clamp 57 or 71 is tightened about the vertical, non-tapered section 15 of the side wall 7 of the container body 3 the clamp 57 or 71 will not be separated from the container body 3 even if the container body 3 is turned upside down since, in such a position, the clamp 57 or 71 will rest on the upwardly sloped lower surface 11 of the container body lip 9.

The container body 3 and circular lid 29 of the present salvage drum 1 are preferably formed of polyethylene and are preferably blow molded to the shape desired. Other plastic materials may, of course, be used. The clamp 57 or 71 is preferably formed of metal, although the clamp 57 or 71 may also be formed of a plastic material which has sufficient strength to retain the container body 3 and circular lid 29 secure while compressing the gasket 67 therebetween to seal the assembly.

Referring now to FIGS. 17 to 21, the novel spreadable circular clamp ring 71 is illustrated according to the present invention. The spreadable clamp ring 71 has a first arcuate clamp section 73, a second arcuate clamp section 75, and a third arcuate clamp section 77, which clamp sections form a circular clamp ring. Each of the arcuate clamp sections 73, 75 and 77 has an outer planar wall 79, an inwardly directed upper wall 81 and an inwardly directed lower wall 83. Each outer planar wall 79 has an outer surface 85. The first arcuate clamp section 73 has a connecting end 87 and a locking end 89 and the second arcuate clamp section 75 has a connecting end 91 and a locking end 93. The third arcuate clamping section 77 has a first connecting end 95 and a second connecting end 97.

In order to secure the arcuate clamping sections together to form a circular clamp ring, a first connector strip 99, preferably of metal, is secured, such as by welds 101, at one end 103 to the outer surface 85 of the outer planar wall 79 adjacent the connecting end 87 of the first arcuate clamp section 73 and at the other end 105, such as by welds 107, to the outer surface 85 of the outer planar wall 79 adjacent the first connecting end 95 of the third arcuate clamp section 77. A second connector strip 109, also preferably of metal, is secured, such as by welds 111, at one end 113 to the outer surface 85 of the outer planar wall 79 adjacent the connecting end 91 of the second arcuate clamp section 75 and at the other end 115, by welds 117 to the outer surface 85 of the outer planar wall 79 adjacent the second connecting end 97 of the third arcuate clamp section 77.

A means 119 for locking the locking ends 89 and 93 respectively of first and second arcuate clamp sections 73 and 75 is provided so as to lock the ring clamp and secure a lid lip to a body lip of a container. For example, as illustrated, locking end 89 of first arcuate clamp section 73 may have a first locking flange 121 welded or otherwise secured thereto, which first locking flange 121 has a bore 123 therethrough, while the locking end 93 of second arcuate clamp section 75 may have a second locking flange 125 welded or otherwise secured thereto, which second locking flange 125 has a threaded bore 127 therethrough which threaded bore 127 may be axially aligned with bore 123. When the circular clamp ring is in locking position, as illustrated in FIGS. 17–20, a threaded bolt 129 is passed through bore 123 and threadably secured in bore 127, while a locking nut 131 may be provided on the threaded bolt 129 between flanges 121 and 125.

Figure 19:
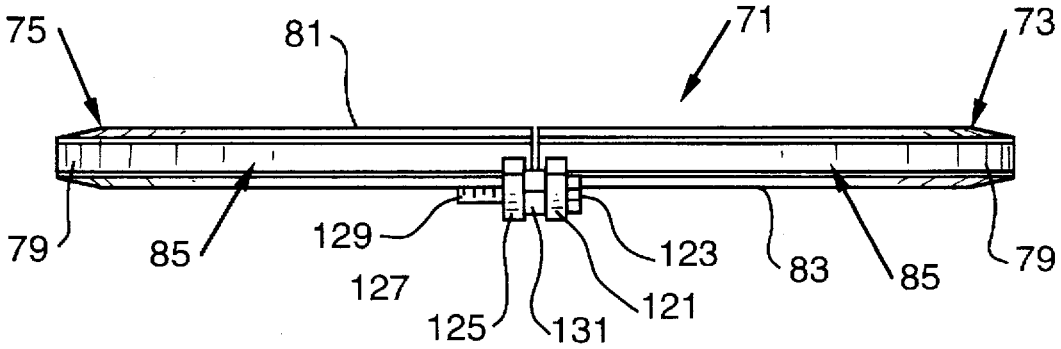
FIG. 19 is a front elevational view of the spreadable circular ring clamp illustrated in FIG. 17.
Figure 20:
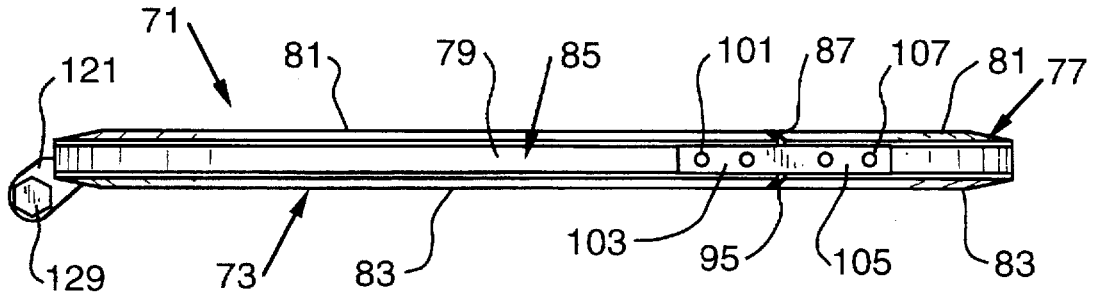
FIG. 20 is a side view of the spreadable circular ring clamp from the right side as illustrated in FIG. 17.

As best seen in FIGS. 19 and 20, the inwardly directed upper wall 81 of each arcuate clamp section preferably extends upwardly at an acute angle away from the top of outer planar wall 79, while the inwardly directed lower wall 83 of each arcuate clamp section preferably extends downwardly at an acute angle away from the bottom of the outer planar wall 79. By limiting the securement of the connector strips to the outer surface 85 of the outer planar wall 79, spreading of the clamp sections is effected without binding, twisting of, or damage to the upper and lower inwardly directed walls 81 and 83.

Figure 21:
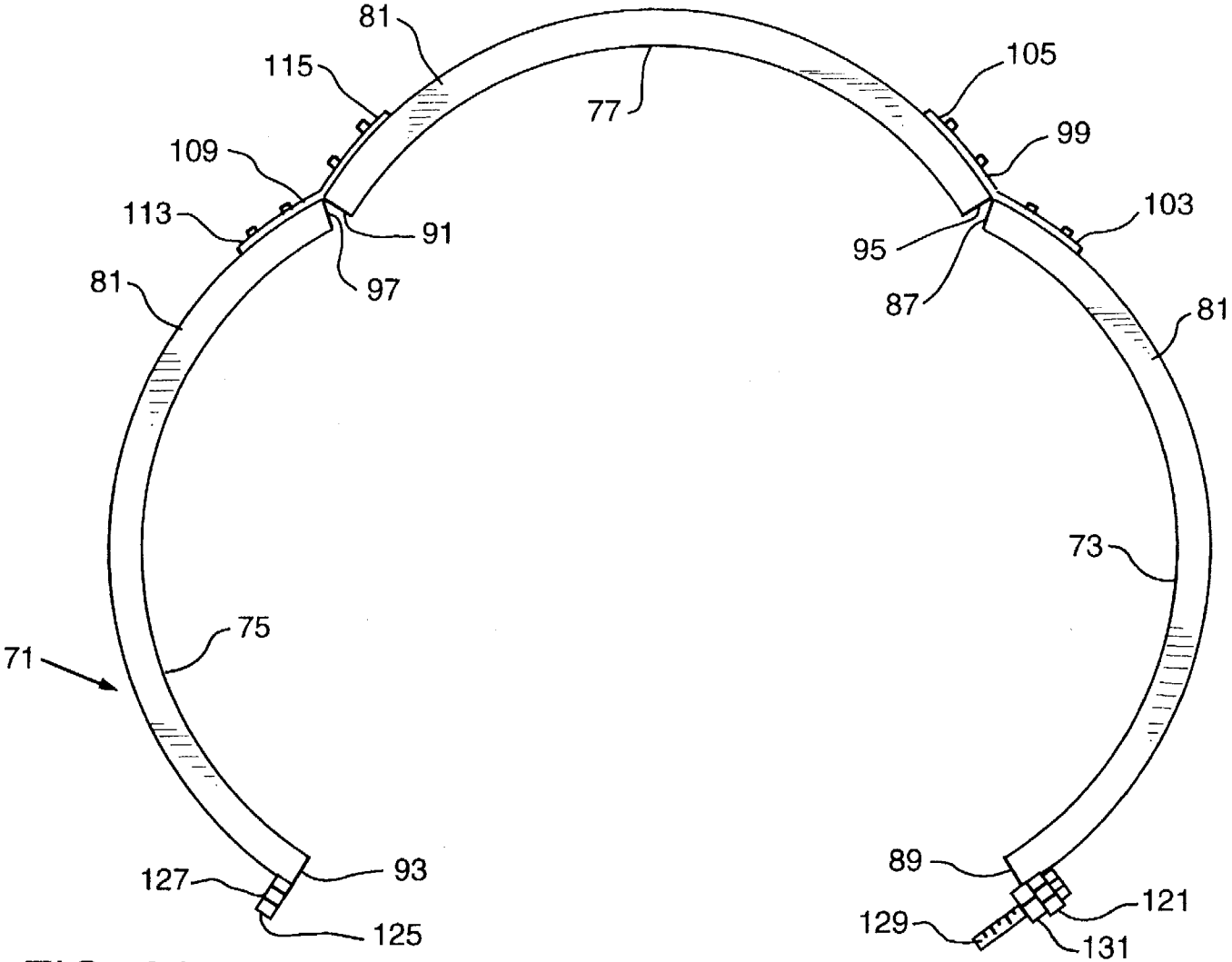
FIG. 21 shows the spreadable circular ring clamp of FIG. 17 with the locking ends spread apart to ease placement of the clamp over lips of a container lid and body for securement thereto.

In securing a circular lid to a container body, each of which have outwardly extending lips, the spreadable circular clamp ring 71 is opened as shown in FIG. 21 to permit placement of the two lips in the space between inwardly directed upper wall 81 and inwardly directed lower wall 83 of the third clamp section 77 and the locking ends 89 and 93 respectively of first and second clamp sections 73 and 75 are brought into closely adjacent or contiguous relationship to close the clamp ring and secure the remainder of the lid and container body lips together. The threaded bolt is then passed through flange 121 and threaded through flange 125 to lock the locking ends 89 and 93 together, preferably with a locking nut 131 provided between the flanges.

In the preferred embodiment illustrated, the third clamp section 77 is a single unit, although the third clamp section 77 may, if desired, be subdivided into two or more segments and further connector strips used to secure together contiguous segments. For example, where the third clamp section 77 is divided into two segments a connector strip would be secured to and connect the two segments together.

The present spreadable circular ring clamp enables ready securement of a lip of a lid to a lip of a container body and sealing of the two so as to provide a sealed container, such as a salvage drum.

What is claimed is:

1. A salvage drum comprising:

a container body having a bottom wall and an upwardly extending side wall terminating to form a circular open top, with a radially outwardly extending body lip on said side wall about said open top, the side wall having a plurality of spaced outwardly extending vertical ribs spaced from and adjacent to said outwardly extending body lip;

a circular lid having a radially outwardly extending lip about the periphery thereof adapted to mate with said body lip, said circular lid having an outwardly extending protective shoulder thereabout, said protective shoulder having a radially outermost surface;

means for clamping said body lip and said lid lip together to seal the salvage drum, said means for clamping situate radially inwardly from upper outer surfaces of said vertical ribs and from the radially outermost surface of said protective shoulder, and comprising a spreadable circular ring clamp having first, second, and third arcuate clamp sections, each having an outer planar wall having an outer surface, and inwardly directed upper and lower walls, said first clamp section having a connecting end and a locking end; said second clamp section having a connecting end and a locking end; and said third clamping section having first and second connecting ends;

a first connector strip secured at one end to the outer surface of the outer planar wall of the connecting end of said first clamp section and at the other end to the outer surface of the outer planar wall of the first connecting end of said third clamp section;

a second connector strip secured at one end of the outer surface of the outer planar wall of the connecting end of said second clamp section and at the other end to the outer surface of the outer planar wall of the second connecting end of said third clamp section; and means on the locking ends of said first second clamp sections permitting spreading apart of the locking ends of said first and second clamp sections in an unlocked position and locking together of said locking ends of said first and second clamp sections in a locking position to clamp said body lip and said lid lip together to seal the container.

2. A salvage drum as defined in claim 1 wherein said first connector strip and said second connector strip are secured to the respective clamp sections by welding.

3. A salvage drum as defined in claim 1 wherein said means for locking ends of said first and second clamp sections comprises a first locking flange having a bore therethrough on the locking end of said first arcuate clamp section and a second locking flange having a threaded bore therethrough on the locking end of said second arcuate clamp section, with a threaded bolt passing through the bore of said first locking flange and threadably engageable in the threaded bore of said second locking flange.

4. A salvage drum as defined in claim 3 wherein a locking nut is provided on said threaded bolt between said flanges.

5. A salvage drum as defined in claim 1 wherein the inwardly directed upper wall of each of said arcuate clamp sections extends upwardly at an acute angle away from the top of said outer wall.

6. A salvage drum as defined in claim 1 wherein the inwardly directed lower wall of each of said arcuate clamp sections extends downwardly at an acute angle away from the bottom of said outer wall.

7. A salvage drum as defined in claim 1 wherein said third arcuate clamp section is divided into at least two segments and a further connector strip secures contiguous said segments together.

8. A salvage drum as defined in claim 1 wherein the side wall of said container body tapers outwardly from said bottom wall towards said circular open top and wherein a vertical nontapered section is provided between said ribs and said lip.

9. A salvage drum as defined in claim 1 wherein a sealing gasket is disposed between said body lip and said lid lip.

10. A salvage drum as defined in claim 1 wherein said spreadable circular ring clamp is positioned about the container body and rests on said vertical ribs prior to clamping said body lip and lid lip together.

11. A salvage drum as defined in claim 1 wherein said container body and said circular lid are of blow molded polyethylene.

12. A salvage drum as defined in claim 1 wherein said lid lip has a downwardly sloped upper surface and a downwardly extending retention flange and said body lip has an upwardly sloped lower surface and an upwardly extending retention flange, which flanges mate together when said lid is secured on said body.

13. A salvage drum as defined in claim 12 wherein said circular lid has a downwardly depending skirt, and a gasket receiving channel is formed between said skirt and said downwardly extension retention flange.

14. A salvage drum as defined in claim 13 wherein a gasket is secured in said gasket receiving channel which contacts the upwardly extending retention flange of said body lip to form a seal therebetween.

* * * * *